US005520499A

United States Patent [19]

Ufheil et al.

[11] Patent Number: 5,520,499

[45] Date of Patent: May 28, 1996

[54] PROGRAMMABLE RIDE CONTROL

[75] Inventors: Steven T. Ufheil, Peoria; Stephen W. Rector, Metamora, both of Ill.

[73] Assignee: Caterpillar Inc., Peoria, Ill.

[21] Appl. No.: 274,085

[22] Filed: Jul. 12, 1994

[51] Int. Cl.[6] ..... E02F 3/00

[52] U.S. Cl. ..... 414/685; 414/719; 60/413

[58] Field of Search ..... 414/685, 719; 60/413

[56] References Cited

U.S. PATENT DOCUMENTS

| | | | |
|---|---|---|---|
| 3,122,246 | 2/1964 | Freedy et al. | 414/713 |
| 4,953,723 | 9/1990 | Saotome et al. | 60/413 X |
| 5,116,188 | 5/1992 | Kurohashi et al. | 414/719 |
| 5,147,172 | 9/1992 | Hosseini | 414/719 |

*Primary Examiner*—Donald W. Underwood
*Attorney, Agent, or Firm*—James R. Yee

[57] ABSTRACT

The present invention provides a ride control 100 for a machine having an implement and a hydraulic lift cylinder. The hydraulic lift cylinder is adapted for moving the implement to and between a plurality of positions. The ride control is controllable between a RIDE CONTROL ON mode, a RIDE CONTROL OFF mode and a RIDE CONTROL PROGRAM mode. In the RIDE CONTROL ON mode, the ride control connects and disconnects an accumulator from the hydraulic lift cylinder circuit as a function of machine velocity. In the RIDE CONTROL OFF mode, the ride control disconnects the accumulator from the hydraulic lift cylinder circuit. In the RIDE CONTROL PROGRAM mode, the ride control sets the threshold for activation of the ride control to the current machine velocity.

4 Claims, 2 Drawing Sheets

PROGRAMMABLE RIDE CONTROL

TECHNICAL FIELD

The present invention relates generally to an apparatus and method for engaging and disengaging a ride control on a work machine, and more particularly to an apparatus and method for controllably engaging and disengaging a ride control on a work vehicle having a hydraulic lift cylinder for positioning an implement.

BACKGROUND ART

Machines such as wheel type loaders includes work implements capable of being moved through a number of positions during a work cycle. Such implements typically include buckets, forks, and other material handling apparatus. The typical work cycle associated with a bucket, for example, includes filling the bucket with material, carrying the material to a dump site, and dumping the material from the bucket.

Machines of this type generally do not include shock-absorbing suspension systems. Thus, as the machine is travelling, the forces exerted on the machine by the terrain cause the machine to pitch and/or bounce which result in considerable operator discomfort and increased wear on the machine.

When the lift cylinders are rigidly maintained in position while the machine is travelling, the bucket and lift arm assembly move in connection with the pitching and bouncing of the machine. The substantial mass of the bucket and lift arm assembly, particularly when the bucket is filled with material, tends to exacerbate the effects of the pitching and bounces.

In an effort to reduce the effects of these forces, hydraulic accumulators have been added to the lift cylinder hydraulic circuit. Such an arrangement is disclosed in U.S. Pat. No. 3,122,246, issued to Freedy et al. on Feb. 25, 1964. This arrangement allows hydraulic fluid to flow from the head end of the lift cylinder to an accumulator and from the rod end of the lift cylinder to a fluid reservoir.

Thus, when the machine is pitching the forces that would otherwise be transferred to the lift arm assembly and bucket are absorbed by the accumulator. In this way, the lift arm assembly and bucket tend to be isolated from the pitching and bouncing of the machine. Since the mass of the lift arm assembly and bucket is not involved in the pitching and bouncing, the effects in the vehicle are lessened.

However, when the machine is loading material into the bucket, substantially all of the forces produced by the drivetrain of the machine should be transferred to the bucket. If the accumulator is connected to the lift cylinder while the machine is loading material in the bucket, much of the force needed to fill the bucket with material will be absorbed by the accumulator. The resulting loss of force applied to the bucket causes reduced loading performance. To address this problem, the Freedy et al patent disclosed a manual switch for opening and closing a valve between the lift cylinders and the accumulator. The manual switch, however, requires operator attention each time the valve is opened or closed.

One effort to provide a system which required less operator intervention, is disclosed in U.S. Pat. No. 5,147,172, issued to Javad Hosseini on Sep. 15, 1992 and assigned to the assignee of the present invention. The Hosseini patent discloses a ride control system which connects and disconnects an accumulator from a lift cylinder hydraulic circuit as a function of machine ground speed. In other words, the system activates the ride control system when ground speed is above a set value and deactivates the ride control system when ground speed is below a second set value.

However, it has been found that different operators have different preferences for the operation of the machine. In other words, some operators prefer better control over implement actuation over a wider speed range than other operators.

The present invention is directed at solving one or more of the problems as set forth above.

DISCLOSURE OF THE INVENTION

In one aspect of the present invention, a ride control for a machine having an implement and a hydraulic lift cylinder is provided. The hydraulic lift cylinder is adapted for moving the implement to and between a plurality of positions. The ride control is controllable between a RIDE CONTROL ON mode, a RIDE CONTROL OFF mode and a RIDE CONTROL PROGRAM mode. In the RIDE CONTROL ON mode, the ride control connects and disconnects an accumulator from the hydraulic lift cylinder circuit as a function of machine velocity. In the RIDE CONTROL OFF mode, the ride control disconnects the accumulator from the hydraulic lift cylinder circuit. In the RIDE CONTROL PROGRAM mode, the ride control sets the threshold for activation of the ride control to the current machine velocity.

In another aspect of the present invention, a method for controllably engaging and disengaging a ride control in a machine having an implement and a hydraulic lift cylinder is provided. The method includes the steps of sensing machine velocity and producing a ride control signal. The ride control signal has one of three values corresponding to one of a RIDE CONTROL ON mode, a RIDE CONTROL OFF mode and a RIDE CONTROL PROGRAM mode, respectively. In the RIDE CONTROL ON mode, the method connects and disconnects an accumulator from the hydraulic lift cylinder circuit as a function of machine velocity. In the RIDE CONTROL OFF mode, the method disconnects the accumulator from the hydraulic lift cylinder circuit. In the RIDE CONTROL PROGRAM mode, the method sets the threshold for activation of the ride control equal to the current machine velocity.

BEST MODE FOR CARRYING OUT THE INVENTION

Figure 1:
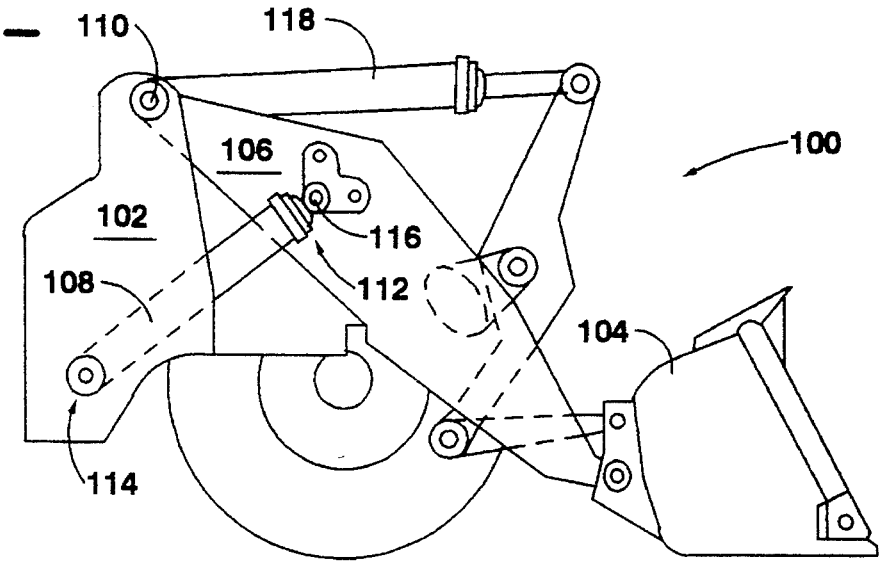
FIG. 1 is a side view of a front portion of a loader machine embodying the present invention.

In FIG. 1 an automatic, programmable ride control is generally represented by the element number 100.. Although FIG. 1 shows a forward portion of a wheel type loader machine 102 having a payload carrier in the form of a bucket 104, the present invention is equally applicable to machines such as track type loaders and other machines having similar implements. The bucket 104 is connected to a lift arm assembly 106, which is pivotally actuated by two hydraulic lift cylinders 108 (only one of which is shown) about a pair of lift arm pivot pins 110 (only one shown) attached to the frame. Each lift cylinder 108 includes a rod end 112 and a head end 114. A pair of lift arm bearing pivot pins 116 (only one shown) are attached to the lift arm assembly 106 and the lift cylinders 108. The bucket 104 can also be tilted by a bucket tilt cylinder 118.

Figure 2:
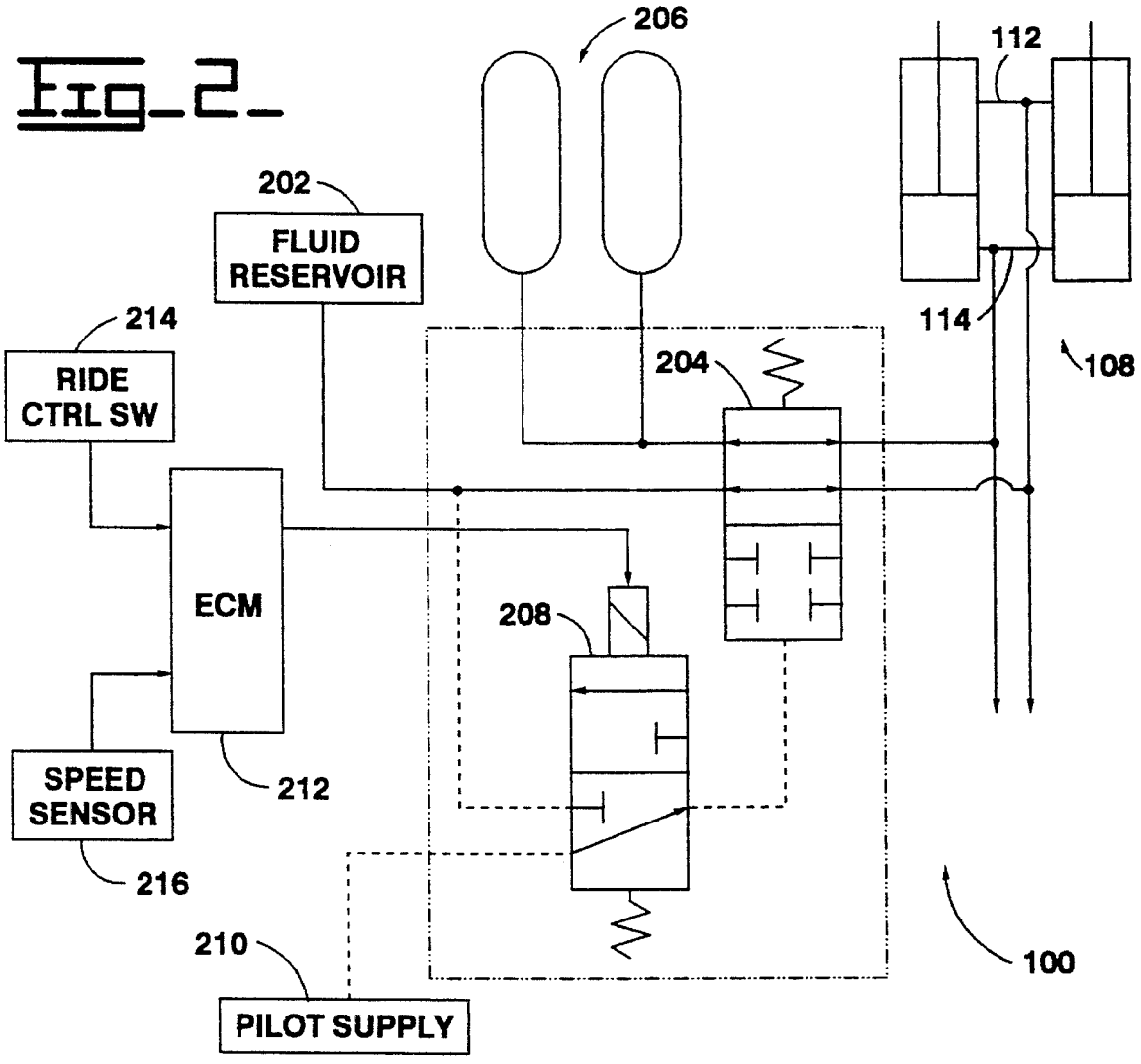
FIG. 2 is a diagrammatic view of an embodiment of the present invention.

Referring now to FIG. 2, the lift cylinders 108 are shown in connection with a hydraulic circuit. The rod end 112 and head end 114 of each lift cylinder 108 are connect to a hydraulic implement valve (not shown) via hydraulic circuitry. The hydraulic implement valve is of a type well-known in the art for controllable extending and retracting a hydraulic cylinder and will not be further discussed.

The rod end 112 is connected to a fluid reservoir 202 via a control valve 204. The head end 114 is connected to a pair of accumulators 206 via the control valve 204. While the preferred embodiment includes two accumulators 206 it should appreciated that many systems embodying the present invention may require more or less than two depending on the size and capacity of the associated hydraulic system.

The control valve 204 is advantageously a pilot operated valve of a type well-known in the art and is controllably opened and closed in response to a hydraulic pilot signal from an electrohydraulic pilot valve 208. When the control valve 204 is open, hydraulic fluid is allowed to pass between the rod end 112 and the fluid reservoir 202 and between the head end 114 and the accumulators 206. When the control valve 204 is closed, hydraulic fluid is prevented from passing between the rod end 112 and the reservoirs and between the head end 114 and the accumulators 206.

The electrohydraulic pilot valve 208 is advantageously in hydraulic communication with the control valve 204 and a pilot supply 210 and in electronic communication with a controller 212. The electrohydraulic pilot valve 208 directs pressurized fluid from the pilot supply 210 to the control valve 204 in response to receiving a "close" control signal from the controller 212. When the electrohydraulic pilot valve receives an "open" control signal from the controller 212, pressurized fluid is prevented from flowing between the pilot supply 210 and the control valve 204.

In the preferred embodiment, the control valve 204 is closed (as described above) in response to receiving the hydraulic pilot signal from the electrohydraulic pilot valve 208 and is open (as described above) in response to the electrohydraulic pilot valve 208 preventing the hydraulic pilot signal from reaching the control valve 204. It should be appreciated, however, that control valves which open in response to receiving the hydraulic pilot signal and close in response to the electrohydraulic pilot valve 208 preventing the hydraulic signal from reaching the control valve would also be operable in connection with the present invention.

While the control valve 204 is described as a pilot operated valve, it should also be understood that the control valve 204 may take the form of an electrohydraulic valve which receives electrical control signals directly from the controller 212.

The controller 212 is in electrical communication with a ride control switch 214 and a machine speed sensor 216. The ride control switch 214 is typically mounted at the operator station of the machine. Advantageously, the ride control switch 214 is a three position switch. The first, second, and third positions correspond to a RIDE CONTROL ON mode, a RIDE CONTROL OFF mode, and a RIDE CONTROL PROGRAM mode, respectively.

The speed sensor 216 is preferably connected to the machine transmission (not shown) and produces a velocity signal indicative of the angular velocity of the transmission output shaft. As is known to one skilled in the art, a signal representing the angular velocity of the transmission output can be easily converted to represent the speed of the machine by multiplying the angular velocity by a simple conversion factor. The precise conversion factor is dependent upon the specifications of the machine of interest, e.g., the size of the differential reduction gear, the final drive, the rolling radius of the tires. It should be appreciated, however, that the particular form of the speed sensor 216 is not essential to the operation of the present invention. For example, speed sensors connected to the wheels of the machine would also be operable with the present invention.

Figure 3:
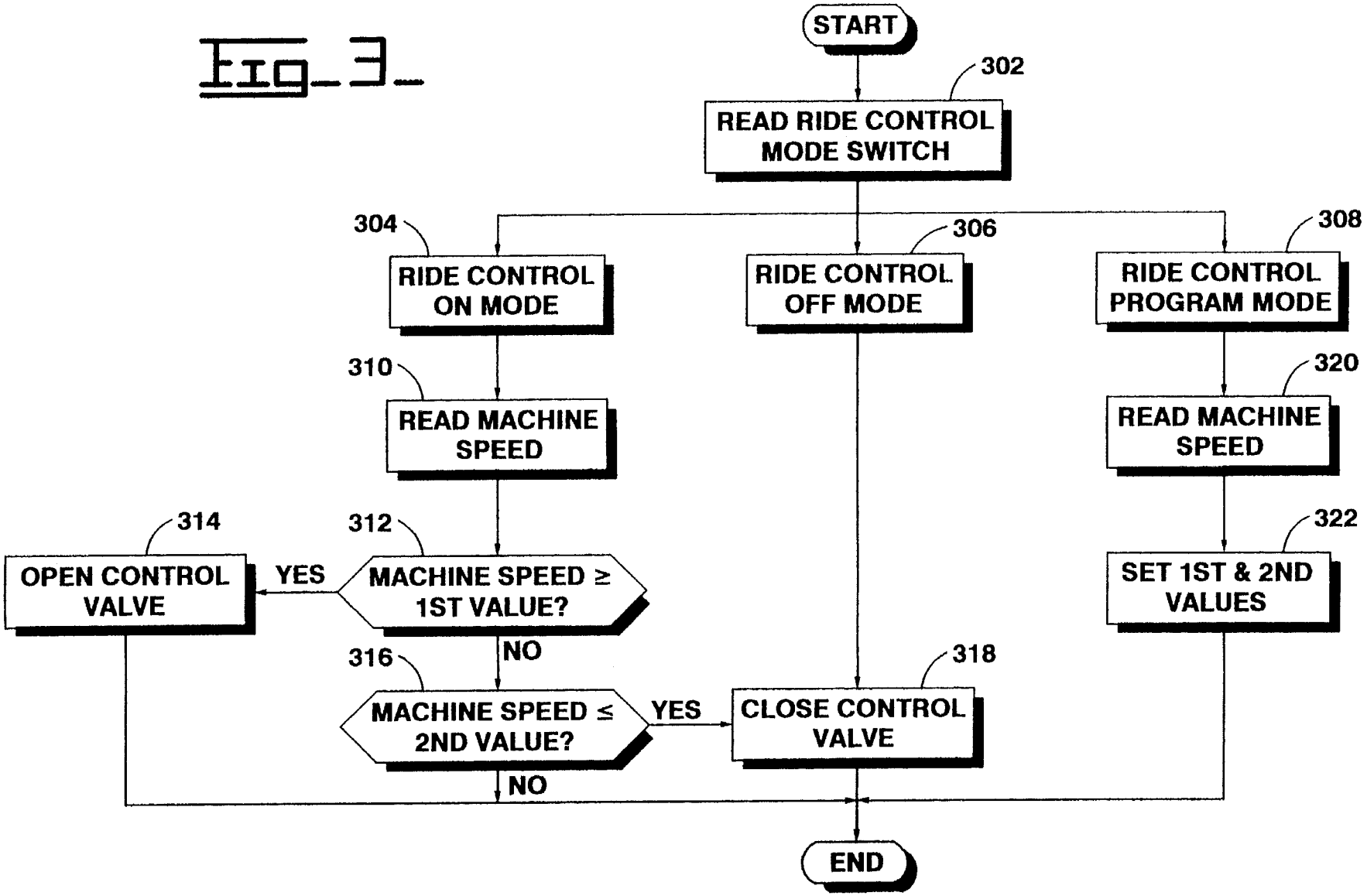
FIG. 3 is a block diagram illustrating the function of a portion of an embodiment of the present invention.

Referring primarily to FIG. 3, the function of the controller 212 is generally illustrated. The controller 212 reads the signal from the ride control switch 214 in a first control block 302. Control proceeds to second, third, and fourth control blocks 304, 306, 308 depending upon whether the ride control switch is in the RIDE CONTROL ON, RIDE CONTROL OFF, or RIDE CONTROL PROGRAM mode, respectively.

If the ride control switch 214 indicates the RIDE CONTROL ON mode, control proceeds to a fifth control block 310. In the fifth control block 310, the controller 212 reads the velocity signal from the speed sensor 216. In a first decision block 312, if the velocity signal is greater or equal to a first predetermined value, then control proceeds to a sixth control block 314. In the sixth control block 314, the controller 212 opens the control valve 204 thereby connecting the accumulators 206 into the lift cylinder hydraulic circuit.

If the velocity is less than the first predetermined value, than control proceeds to a second decision block 316. In the second decision block 316, if the velocity is less than or equal to a second predetermined value than control proceeds to a seventh control block 318. In the seventh control block 318, the controller 212 closes control valve 204, thereby disconnecting the accumulators 206 from the lift cylinder hydraulic circuit.

If the ride control switch 214 is in the RIDE CONTROL OFF mode, then control proceeds to the seventh control block 318.

If the ride control switch 214 is in the RIDE CONTROL PROGRAM mode, then control proceeds to an eighth control block 320. The RIDE CONTROL PROGRAM mode allows the operator to set the machine velocity at which the accumulators will be connected into the lift cylinder hydraulic circuit. Thus, in the eighth control block 320, the controller 212 reads the machine velocity from the speed sensor 216. In a ninth control block 322, the controller sets the first and second predetermined values as a function of the machine velocity.

In the preferred embodiment, the first predetermined value is set equal to the current machine velocity and the second predetermined value is set equal to the first predetermined value less a constant. Typical values for the first and second predetermined values are 5 and 4.5 kilometers per hour (KPH), respectively.

Using these two values, if the machine speed is greater than or equal to 5 KPH and the ride control is in the RIDE CONTROL ON mode, then the controller will open the control valve 204 and connect the accumulators into the circuit. If the machine speed is less than or equal to 4.5 KPH than the controller 212 will close the control valve 204, disconnecting the accumulators 206 from the circuit. If the velocity is between these two values, a hysteresis effect is produced. This prevents the chance occurrence that at or close to 5 KPH, the ride control will oscillate, connecting and disconnecting the accumulators.

INDUSTRIAL APPLICABILITY

The present invention is particularly useful in connect with work machines that perform a variety of functions such as loading and carrying material. In many application, the range of ground speeds at which the vehicle is travelling during the loading function is substantially different from the range of ground speeds associated with the carrying function.

Since a ride control feature provides significant advantages to such a machine while performing the carrying function but includes substantial drawbacks while the machine is performing the loading function, the automatic ride control of the present invention is provided to automatically activate and deactivate the ride control in response to engine speed. while the machine is travelling at the speeds associated with the carrying function, the ride control is activated; and while the machine is travelling at speeds associated with the loading function, the ride control is deactivated. Since the ride control is automatically activated and deactivated, operator workload and fatigue are reduced thus improving operator performance. In addition, since every operator operates a machine differently, each operator may set the speeds at which the ride control is activated and deactivated.

Other aspects, objects, and features of the present invention can be obtained from a study of the drawings, the disclosure, and the appended claims.

We claim:

1. In a machine having an implement and a hydraulic lift cylinder for moving the implement to and between a plurality of positions, a ride control comprising:

means for sensing a velocity of the machine and responsively producing a velocity signal;

a hydraulic accumulator;

a control valve connected to and between said hydraulic accumulator and the lift cylinder, said control valve having an open state in which hydraulic fluid pass between the lift cylinder and said hydraulic accumulator and a closed state in which hydraulic fluid is prevented from passing between the lift cylinder and said hydraulic accumulator;

switching means for generating a ride control mode signal, said ride control signal having one of a first, second and third values, corresponding to one of a RIDE CONTROL ON mode, a RIDE CONTROL OFF mode and a RIDE CONTROL PROGRAM mode, respectively; and control means, connected to said switching means and said control valve, for receiving said ride control mode signal and said velocity signal, and for opening said control valve in response to said velocity signal being greater than a first predetermined magnitude, if said ride control mode signal is equal to said first value, closing said control valve, if said ride control mode signal is equal to said second value, and setting said first predetermine value equal to said velocity signal, if said ride control mode signal is equal to said third value.

2. The invention, as set forth in claim 1, wherein said control means includes means for closing said control valve in response to said velocity signal being less than a second predetermined value, if said ride control mode signal is equal to said first value.

3. In a machine having an implement and a hydraulic lift cylinder for moving the implement to and between a plurality of positions, a ride control comprising:

means for sensing a velocity of the machine and responsively producing a velocity signal;

a hydraulic accumulator;

a control valve connected to and between said hydraulic accumulator and the lift cylinder, said control valve having an open state in which hydraulic fluid pass between the lift cylinder and said hydraulic accumulator and a closed state in which hydraulic fluid is prevented from passing between the lift cylinder and said hydraulic accumulator;

a pilot valve hydraulically coupled with said control valve;

switching means for generating a ride control mode signal, said ride control signal having one of a first, second and third values corresponding to one of a RIDE CONTROL ON mode, a RIDE CONTROL OFF mode and a RIDE CONTROL PROGRAM mode, respectively; and control means, connected to said switching means and said pilot valve, for receiving said ride control mode signal and said velocity signal, and for delivering a first electrical signal to said pilot valve in response to said velocity signal being greater than a first predetermined magnitude, if said ride control mode signal is equal to said first value, delivering a second electrical signal to said pilot valve, if said ride control mode signal is equal to said second value, and setting said first predetermined value equal to said velocity signal, if said ride control mode signal is equal to said third value.

4. A method for controllably engaging and disengaging a ride control in a machine having an implement and a hydraulic lift cylinder for moving the implement to and between a plurality of positions, comprising:

sensing a velocity of the machine and responsively producing a velocity signal;

producing a ride control signal, said ride control signal having one of a first, second and third values corresponding to a one of a RIDE CONTROL ON mode, a RIDE CONTROL OFF mode and a RIDE CONTROL PROGRAM mode, respectively;

producing a first control signal in response to said velocity signal being greater than a first predetermined magnitude, if said ride control signal is equal to said first value;

producing a second control signal, if said ride control signal is equal to said second value;

setting said first predetermined magnitude equal to said velocity signal, if said ride control mode signal is equal to said third signal;

allowing fluid to flow between a hydraulic accumulator and the lift cylinder in response to said first control signal; and preventing fluid from flowing between the hydraulic accumulator and the lift cylinder in response to the second control signal.

* * * * *